US008051998B1

(12) United States Patent
Giraud et al.

(10) Patent No.: US 8,051,998 B1
(45) Date of Patent: Nov. 8, 2011

(54) PRODUCT CONTAINER WITH INTEGRAL SELECTIVE MEMBRANE

(75) Inventors: Jean-Pierre Giraud, Paris (FR); Joseph W. Rogers, Lafayette Hill, PA (US)

(73) Assignee: CSP Technologies, Inc., Amsterdam, NY (US)

( * ) Notice: Subject to any disclaimer, the term of this patent is extended or adjusted under 35 U.S.C. 154(b) by 460 days.

(21) Appl. No.: 11/427,279

(22) Filed: Jun. 28, 2006

Related U.S. Application Data

(60) Provisional application No. 60/694,581, filed on Jun. 28, 2005.

(51) Int. Cl.
*B65D 51/16* (2006.01)
*B65D 53/00* (2006.01)

(52) U.S. Cl. ..... 215/261; 215/308; 220/370

(58) Field of Classification Search ..... 220/370, 220/372, 371, 367.1; 215/261, 235, 308
See application file for complete search history.

(56) References Cited

U.S. PATENT DOCUMENTS

| | | | | |
|---|---|---|---|---|
| 5,547,694 | A * | 8/1996 | Perry et al. | 426/118 |
| 5,596,814 | A * | 1/1997 | Zingle et al. | 34/296 |
| 5,667,094 | A * | 9/1997 | Rapchak et al. | 220/834 |
| 5,988,414 | A * | 11/1999 | Schwarz et al. | 215/261 |
| 5,988,426 | A * | 11/1999 | Stern | 220/371 |
| 6,095,356 | A * | 8/2000 | Rits | 215/261 |
| 6,193,088 | B1 * | 2/2001 | Vincent et al. | 215/261 |
| 6,196,409 | B1 * | 3/2001 | Lake et al. | 220/371 |
| 6,983,857 | B2 * | 1/2006 | Miller et al. | 215/270 |
| 7,364,048 | B2 * | 4/2008 | Cautereels et al. | 220/254.7 |
| 7,381,453 | B2 * | 6/2008 | Okhai | 428/34.1 |
| 2001/0024821 | A1 * | 9/2001 | Potter | 435/297.5 |
| 2002/0056695 | A1 * | 5/2002 | Boulange et al. | 215/261 |
| 2003/0102323 | A1 * | 6/2003 | Lohn | 220/839 |
| 2007/0051727 | A1 * | 3/2007 | Holley, Jr. | 220/367.1 |

FOREIGN PATENT DOCUMENTS

WO WO 9503949 A1 * 2/1995

* cited by examiner

*Primary Examiner* — Anthony Stashick
*Assistant Examiner* — Niki Eloshway
(74) *Attorney, Agent, or Firm* — Greenberg Traurig, LLP

(57) ABSTRACT

In embodiment, the present invention relates to a cap and container assembly comprising at least one selective gas permeable membrane, wherein the assembly is manufactured so that the membrane is an integral part of the assembly and wherein the membrane is composed of a material for controlling conditions of gas concentration in an internal portion of the assembly when the cap is closed. In another embodiment, the present invention relates to a method of forming a cap and container assembly comprising at least one selective gas permeable membrane that is integral with the assembly comprising: cutting the membrane to a pre-selected form, wherein the membrane is composed of a material for controlling conditions of gas concentration in an internal portion of the assembly when the cap is closed; placing the membrane into a mold by robotic means; and overmolding the assembly about the membrane to form an assembly wherein the membrane is an integral part of the assembly.

7 Claims, 4 Drawing Sheets

PRODUCT CONTAINER WITH INTEGRAL SELECTIVE MEMBRANE

RELATED APPLICATIONS

This application claims the benefit of U.S. Provisional Application Ser. No. 60/694,581 filed Jun. 28, 2005, which is incorporated herein by reference in its entirety.

BACKGROUND OF THE INVENTION

Many products such as fruits, vegetables and fermented tobacco products have biological activity after harvesting and preparation for market. This activity can be described as a respiration process where there is a biological process consuming oxygen from the ambient environment and energy sources inherent in the product and producing carbon dioxide and water as a by product. By packaging these products in an impermeable package, the oxygen will be consumed and moisture produced. As the oxygen is consumed, the process may transition to an anaerobic process and continue, by producing by-products that further degrade the product. Combined with an affinity of some products to be in a narrow humidity range for optimum storage conditions, it is apparent that prolonged storage is a delicate balance of conditions. This is further complicated by variation in optimum conditions for different product types.

Conventionally, membranes can be adhered to the package (e.g. with adhesives or other sealing means) in an attempt to solve the above-discussed problem. However, the sealing of the membrane is a secondary process that is done to the packaging material for the final package, and thus, there is a potential pathway through the seal, which is not controlled. This could result in something other than the designed conditions being present, which may not be known to the user.

SUMMARY OF THE INVENTION

In one embodiment, the present invention relates to a cap and container assembly comprising at least one selective gas permeable membrane, wherein the assembly is manufactured so that the membrane is an integral part of the assembly and wherein the membrane is composed of a material for controlling conditions of gas concentration in an internal portion of the assembly when the cap is closed. In another embodiment, the present invention relates to a method of forming a cap and container assembly comprising at least one selective gas permeable membrane that is integral with the assembly comprising: cutting the membrane to a pre-selected form, wherein the membrane is composed of a material for controlling conditions of gas concentration in an internal portion of the assembly when the cap is closed; placing the membrane into a mold by robotic means; and overmolding the assembly about the membrane to form an assembly wherein the membrane is an integral part of the assembly.

BRIEF DESCRIPTION OF THE DRAWINGS

The following figures are merely illustrative of the present invention and are not meant to limit the invention to the embodiments shown in the figures.

FIGS. 1, 2 and 3 illustrate one embodiment of the present invention wherein FIG. 1 is a top view, FIG. 2 is a cross-sectional side view and FIG. 3 is an enlarged cross-sectional view of the cap of FIG. 2.

FIGS. 4, 5 and 6 illustrate another embodiment of the present invention wherein FIG. 4 is a top view, FIG. 5 is a cross-sectional side view and FIG. 6 is an enlarged cross-sectional view of the cap of FIG. 5.

FIGS. 8, 9 and 10 illustrate yet another embodiment of the present invention wherein FIG. 8 is a top view, FIG. 9 is a cross-sectional side view and FIG. 10 is an enlarged cross-sectional view of a portion of the cap of FIG. 9.

Figure 1:
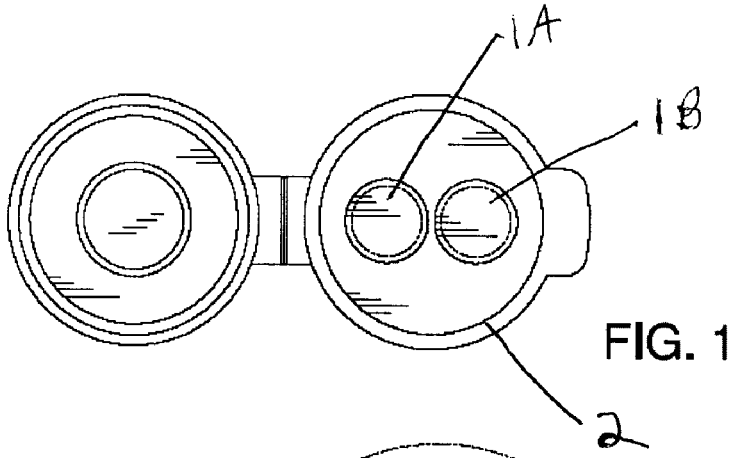

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE EMBODIMENTS OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

In one embodiment, the invention relates to a rigid, resealable container that is moisture-tight and provides a means for controlling the flux of gases into and out of a closed container by having gas permeable panels that are an integral part of the package so that specific conditions can be maintained inside the container.

In yet another embodiment, membranes are made from thermoplastic materials and have selective permeability characteristics whereby the sealed container is capable of maintaining a substantially stable environment conductive to extending product shelf life. As used hereinafter in the description and claims, the terms "selectively permeable" and "selective permeability" shall refer to materials having a preselected level of permeability with respect to a specific gas, the preselected level of permeability being disproportionately high or low when compared to that of other gases. Suitable material that can achieve the selective permeability include, but are not limited to, additives, specific combination of polymers, orientation of the film and mechanical means such as perforation. One or more membranes may be incorporated into the rigid container to achieve the desired gas composition. For example, one membrane may be selectively permeable to oxygen and another membrane may be selectively permeable to carbon dioxide. When the 2-membranes are used in combination in the container, the desired gas mixture is achieved within the container headspace. Different membranes may be used based on the metabolic or chemical characteristics of the product packaged in the container. The subject of the invention is not specific to the method of achieving permeability.

The thermoplastic materials used for the membranes have selective permeability characteristics for particular gases (i.e., oxygen, carbon dioxide, nitrogen) whereby the sealed container is capable of maintaining a modified atmosphere. For example, the product inside the container may consumer oxygen and may produce carbon dioxide. As the oxygen concentration inside the container decreases, oxygen is allowed to permeate into the container through the selective membrane for oxygen. Similarly, as the carbon dioxide concentration inside the container increases, the carbon dioxide is allowed to exit the container the selective membrane for carbon dioxide. These membranes maintain predetermined oxygen and carbon dioxide levels inside the container.

As examples, some products store better in higher oxygen, low carbon dioxide conditions, other products store better in lower oxygen and higher carbon dioxide conditions. Likewise, some products store better in a high or low humidity environment. After identifying the optimum conditions for the particular product to be stored, the materials are chosen. For example, a desiccant material is chosen based on the amount of moisture to be maintained. Membrane materials are chosen based on their ability to have a high or low flux of the gas of interest. Multiple openings are used so that different membranes can be utilized to optimize the flux of gases into the container.

The following is an example of the gas ratios and transmissions rates needed for specific fresh cut fruits and vegetables. As understood, these examples are merely illustrative and not meant to limited the invention.

| PRODUCT | RESP @ 0C ml/kg-hr | OTR and CO2TR in units of cc/(100in2-day-atm) RESP @ 10C ml/kg-hr | AREA (100 in$^2$) | PRODUCT WEIGHT (kg) | DESIRED $O_2$ | DESIRED $CO_2$ | 0C DESIRED OTR | 10C DESIRED OTR | 0C DESIRED $CO_2$TR | 10C DESIRED $CO_2$TR |
|---|---|---|---|---|---|---|---|---|---|---|
| Sliced | 3.5 | 7 | 1 | 0.25 | 0.03 | 0.15 | 117 | 233 | 140 | 281 |
| Apple | 3.5 | 7 | 2 | 0.5 | 0.03 | 0.15 | 117 | 233 | 140 | 281 |
| | 3.5 | 7 | 3 | 1 | 0.03 | 0.15 | 156 | 311 | 187 | 374 |
| Broccoli | 10 | 25 | 1 | 0.25 | 0.03 | 0.15 | 333 | 833 | 401 | 1002 |
| | 10 | 25 | 2 | 0.5 | 0.03 | 0.15 | 333 | 833 | 401 | 1002 |
| | 10 | 25 | 3 | 1 | 0.03 | 0.15 | 444 | 1111 | 534 | 1336 |
| Sliced | 5 | 20 | 1 | 0.25 | 0.03 | 0.15 | 167 | 667 | 200 | 802 |
| Tomatoes | 5 | 20 | 2 | 0.5 | 0.03 | 0.15 | 167 | 667 | 200 | 802 |
| | 5 | 20 | 3 | 1 | 0.03 | 0.15 | 222 | 889 | 267 | 1069 |
| Spinach | 5 | 16 | 1 | 0.25 | 0.03 | 0.15 | 167 | 533 | 200 | 641 |
| | 5 | 16 | 2 | 0.5 | 0.03 | 0.15 | 167 | 533 | 200 | 641 |
| | 5 | 16 | 3 | 1 | 0.03 | 0.15 | 222 | 711 | 267 | 855 |
| Cantaloupe | 5 | 7 | 1 | 0.25 | 0.04 | 0.1 | 176 | 247 | 301 | 421 |
| Cubes | 5 | 7 | 2 | 0.5 | 0.04 | 0.1 | 176 | 247 | 301 | 421 |
| | 5 | 7 | 3 | 1 | 0.04 | 0.1 | 235 | 329 | 401 | 562 |
| Orange | 2.5 | 9 | 1 | 0.25 | 0.1 | 0.1 | 136 | 491 | 150 | 542 |
| Sections | 2.5 | 9 | 2 | 0.5 | 0.1 | 0.1 | 136 | 491 | 150 | 542 |
| | 2.5 | 9 | 3 | 1 | 0.1 | 0.1 | 182 | 655 | 201 | 722 |
| Pineapple | 3 | 15 | 1 | 0.25 | 0.02 | 0.15 | 95 | 474 | 120 | 601 |
| Cubes | 3 | 15 | 2 | 0.5 | 0.02 | 0.15 | 95 | 474 | 120 | 601 |
| | 3 | 15 | 3 | 1 | 0.02 | 0.15 | 126 | 632 | 160 | 802 |
| Peeled | 3 | 11 | 1 | 0.25 | 0.03 | 0.15 | 100 | 367 | 120 | 441 |
| Carrots | 3 | 11 | 2 | 0.5 | 0.03 | 0.15 | 100 | 367 | 120 | 441 |
| | 3 | 11 | 3 | 1 | 0.03 | 0.15 | 133 | 489 | 160 | 588 |
| Shredded | 4 | 9 | 1 | 0.25 | 0.01 | 0.1 | 120 | 270 | 241 | 542 |
| Lettuce | 4 | 9 | 2 | 0.5 | 0.01 | 0.1 | 120 | 270 | 241 | 542 |
| | 4 | 9 | 3 | 1 | 0.01 | 0.1 | 160 | 360 | 321 | 722 |
| Diced | 5 | 12 | 1 | 0.25 | 0.05 | 0.1 | 188 | 450 | 301 | 722 |
| Onions | 5 | 12 | 2 | 0.5 | 0.05 | 0.1 | 188 | 450 | 301 | 722 |
| | 5 | 12 | 3 | 1 | 0.05 | 0.1 | 250 | 600 | 401 | 963 |
| Peeled | 4 | 10 | 1 | 0.25 | 0.02 | 0.08 | 126 | 316 | 301 | 753 |
| Potatoes | 4 | 10 | 2 | 0.5 | 0.02 | 0.08 | 126 | 316 | 301 | 753 |
| | 4 | 10 | 3 | 1 | 0.02 | 0.08 | 168 | 421 | 402 | 1004 |

Selective membrane polymers may include, for example, polyvinyl chloride, poly ethylene vinyl acetate, poly vinylidene chloride, polystyrene, polyester terephthalate, low density polyethylene, polypropylene, polybutylene, metallocene catalyzed polyolefins and poly maleic anhydride. Combinations of thermoplastic polymers can be blended or layered or a layer can be formed from a single thermoplastic polymer.

The addition of the membrane is done at the time of manufacture of the container and cap assembly, so it is provided ready to fill with product and seal. In one embodiment, the membrane(s) are placed into the mold by robotic means. The membranes may be die cut into rounded or rectangular shaped pieces. The membranes may be stacked in a magazine or manufactured on a continuous roll. The membrane may range in thickness from 0.02 mm-0.6 mm and more specifically, 0.1 mm-0.3 mm. After the membrane(s) has been placed into the mold, the rigid container is over molded about the membrane(s). The membrane is an integral part of the rigid container. Thus, there is less possibility of gas leakage due to the membrane not adhered securely to the container.

In one embodiment, the container may be fabricated with an injection molded lining of moisture absorbing desiccant material. Based on the specific application, a gas permeable membrane or membranes are placed into the mold and the container molded.

Several examples of the invention are presented. In each example, the present invention relates to a leakproof and resealable container and cap assembly. The term "resealable" means that the container can be opened/reopened and closed/reclosed a numerous amount of times. The term "leakproof" means that the container passes the blue crystal dye test. The blue crystal dye test is a visual test to detect leaks within a container seal. A container "passes" the blue crystal dye test if the white paper, in which the container is placed on, does not visually change color (i.e. The white paper does not become contaminated with the blue crystal dye liquid from the container). The blue crystal dye test procedure consists of the following: (a) the blue crystal dye liquid is prepared by adding one teaspoon of blue crystal dye powder to one gallon of alcohol and the thoroughly mixing the solution; (b) the blue crystal dye liquid is poured into the container (i.e. a sufficient amount of the dye liquid must be added so, when the container is placed upside down, the entire seal area must be covered); (c) the container is closed by applying, in a singular motion, a frontal downward pressure upon the thumb tab (e.g. a user places his/her thumb parallel or on top of the thumb tab and applies a singular downward pressure) until the rim portion, adjacent to the thumb tab, contacts the inside flat part of the cap; (d) the container is placed upside down (i.e. inverted) on the white paper at room temperature; and (e) after 30 minutes, the white paper is inspected to determine if the white paper is contaminated with the blue crystal dye liquid.

Examples of a resealable container and cap assembly include, but are not limited to those disclosed in U.S. Pat. Nos. 6,769,492 and 7,059,492, such references are incorporated herein In another embodiment, the cap and container assembly, in a closed position, forms an air tight seal. The term "air tight" means the moisture ingress of the container (after 24-hours) was less than about 2500 micrograms of water, preferably, about 1500 micrograms of water, more preferably, about 1000 micrograms of water determined by the following test method: (a) place one gram plus or minus 0.25 grams of molecular sieve in the container and record the weight; (b) the container is closed by applying, in a singular motion, a frontal downward pressure upon the thumb tab until the rim portion, adjacent to the thumb tab, contacts the inside flat part of the cap also adjacent to the thumb tab; (c) place the closed container in an environmental chamber at conditions of 80% relative humidity and 72.degree. F.; (c) after one day, weigh the container containing the molecular sieve; (d) after four days, weigh the container containing the molecular sieve; and (e) subtract the first day sample from the fourth day sample and divide the result by three to calculate the moisture ingress of the container in units of micrograms of water per day.

Figure 2:
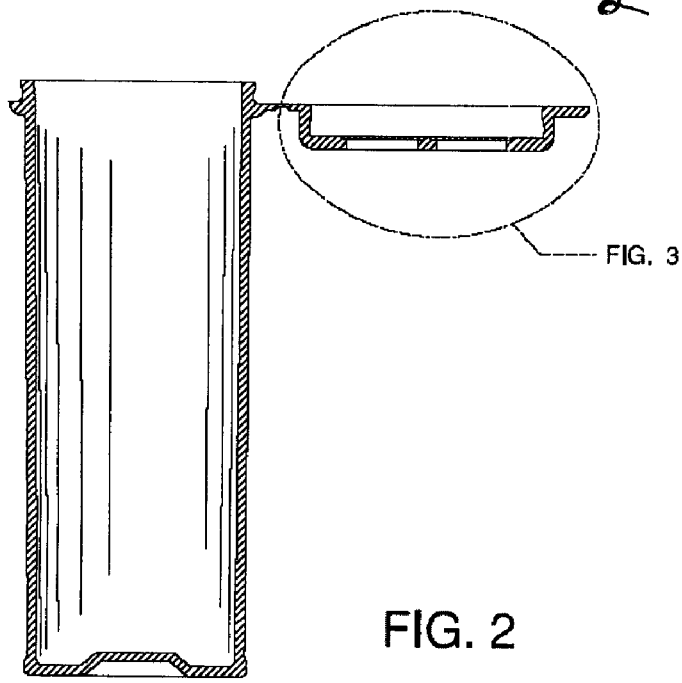
Figure 3:
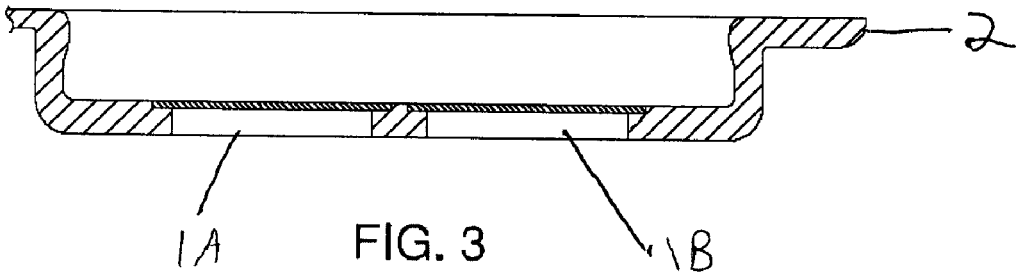

The following are illustrative examples of the present invention. FIGS. 1, 2 and 3 illustrate an embodiment of the present invention. The membranes 1A and 1B are positioned along the under side of the cap 2. The membranes 1A and 1B are over molded into the container at the time of molding. A label or cover may be placed along the top of the cap to protect the membranes from damage. The section view in FIG. 3 shows the membranes 1A and 1B in position on the inside surface of the cap 2. There is a single large opening for each membrane.

Figure 4:
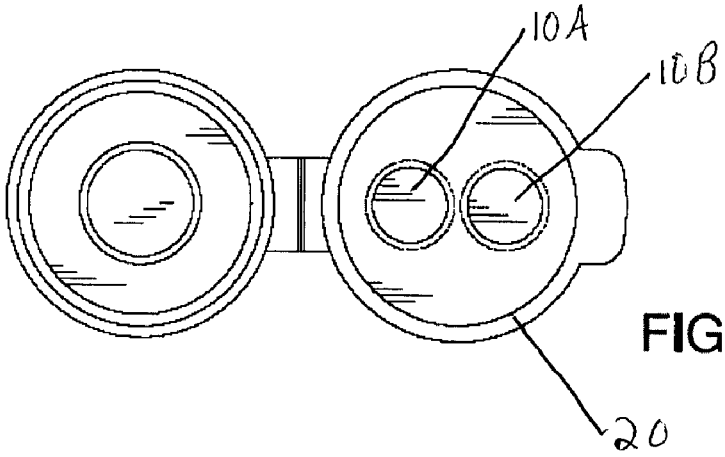
Figure 5:
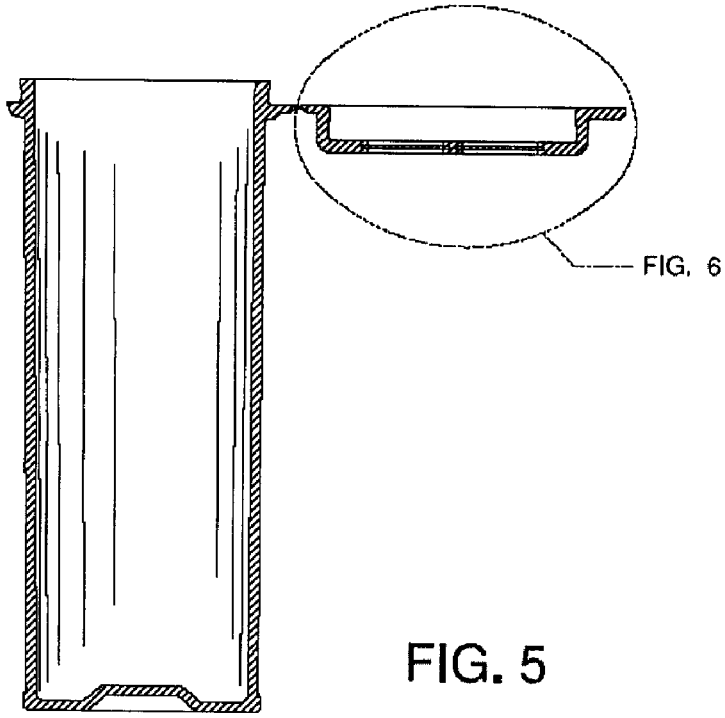
Figure 6:
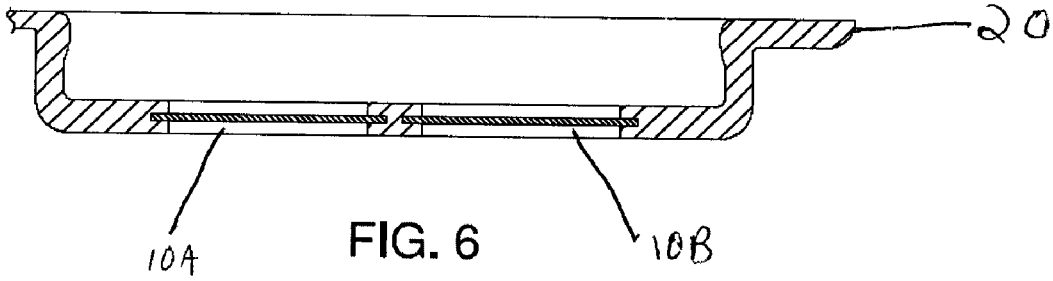
Figure 7:
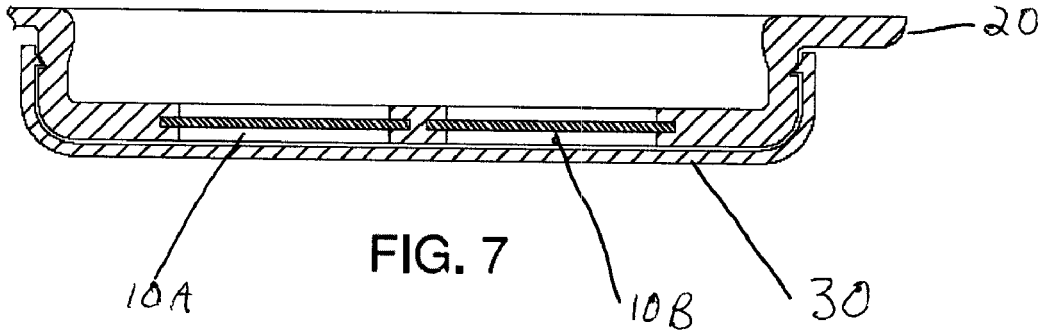
FIG. 7 is another embodiment of an enlarged cross-sectional view of the cap.

FIGS. 4, 5 and 6 illustrate another embodiment where the membranes 10A and 10B are located in the center of the cap 20 cross section with a single large opening for each of the membranes. In one specific example, as shown in FIG. 7, if it is desirable to protect the membranes 10A and 10B form being damaged, a cover 30 that is not sealed to the cap 20, but attached in a way that makes it difficult to remove, is attached. It is understood that the use of a dust cover is not specific to the location of the membrane in the closure.

Figure 8:
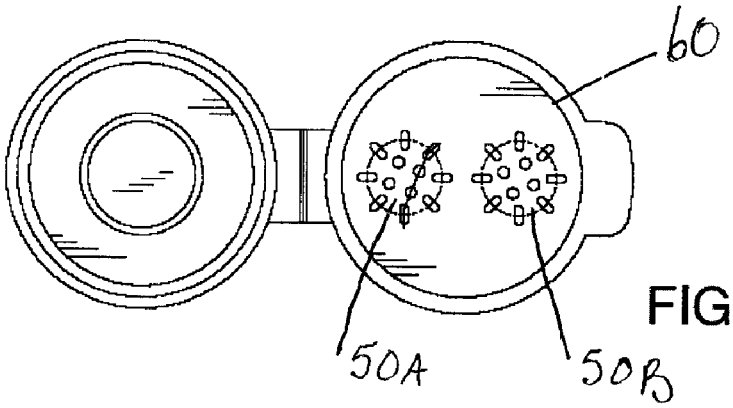
Figure 9:
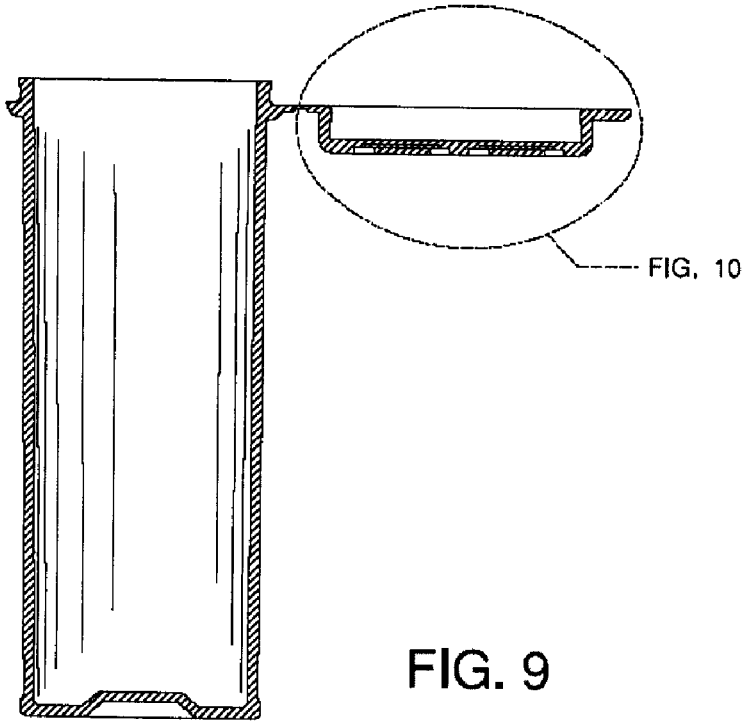
Figure 10:
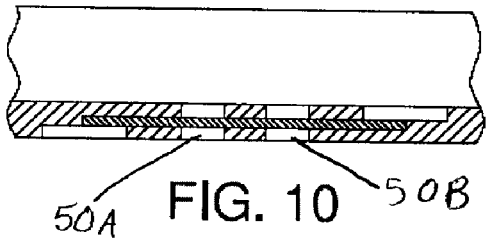

In yet another embodiment, FIGS. 8, 9 and 10 illustrate that the membranes 50A and 50B is over-molded into the cap 60 such that the rigid container plastic is patterned across the membranes. In one embodiment, the patterned may be a cross-hatch (or screen mesh type). This cross hatch pattern of the rigid container plastic over the membrane protects the relatively fragile membrane from damage. In addition, the cross hatch pattern can control the rate of gas transmission by the amount of membrane that is exposed.

In yet another example, FIG. 10 shows a cross section of one membrane located internally in the cap. A series of smaller holes from both sides are formed that allow the amount of exposed area to be adjusted. Around the perimeter are openings that come through from one side or the other that are used to hold the membrane in position while the container is being molded.

Whereas particular embodiments of the present invention have been described above as examples, it will be appreciated that variations of the details may be made without departing from the scope of the invention. One skilled in the art will appreciate that the present invention can be practiced by other than the disclosed embodiments, all of which are presented in this description for purposes of illustration and not of limitation. It is noted that equivalents of the particular embodiments discussed in this description may practice the invention as well. Therefore, reference should be made to the appended claims rather than the foregoing discussion of examples when assessing the scope of the invention in which exclusive rights are claimed.

What is claimed is:

1. An integral cap and container assembly comprising:

a container having sidewalls, a closed bottom end and opening at an upper end;

a cap having a base with an inside surface and an outside surface;

a hinge attached to the container and the to the cap at a first end of the cap and a first end of the container to form the integral cap and container assembly;

a first selectively permeable membrane that is formed as an integral part of the cap for controlling conditions of gas concentration in an internal portion of the assembly when the cap is closed;

a second selectively permeable membrane that is formed as an integral part of the cap for controlling of gas concentration in an internal portion of the assembly when the cap is closed; and a moisture tight resealable configuration formed between the cap and the sidewalls of the container;

wherein the first and second selectively permeable membranes are selectively permeable to different gases, the first selectively permeable membrane allows permeation of a first gas and not a second gas, and the second selectively permeable membrane allows permeation of the second gas and not the first gas.

2. The integral cap and container assembly of claim 1, wherein the first gas is oxygen and the second gas is carbon dioxide.

3. The integral cap and container assembly of claim 1, wherein the cap base defines an area, and the first and second selectively permeable membranes are located at different regions of the area.

4. The integral cap and container assembly of claim 1, wherein the cap base defines first and second openings, the first selectively permeable membrane extends across the first opening, and the second selectively permeable membrane extends across the second opening.

5. The integral cap and container assembly of claim 1, wherein the first and second selectively permeable membranes are each positioned to form a portion of the inside surface of the cap base.

6. The integral cap and container assembly of claim 1, wherein the first and second selectively permeable membranes are each positioned between the inner surface and the outer surface of the cap base.

7. The integral cap and container assembly of claim 1, wherein the cap further comprises a removable cover, positioned over the first selectively permeable membrane.

* * * * *